US005754301A

United States Patent [19]

Schnaeker

[11] Patent Number: 5,754,301

[45] Date of Patent: May 19, 1998

[54] POTENTIOMETER

[75] Inventor: Aloys Schnaeker, Filderstadt, Germany

[73] Assignee: Robert Bosch GmbH, Stuttgart, Germany

[21] Appl. No.: 712,093

[22] Filed: Sep. 16, 1996

[30] Foreign Application Priority Data

Sep. 14, 1995 [DE] Germany ..... 195 33 991.6

[51] Int. Cl.[6] ..... H01C 10/26; H01C 10/32

[52] U.S. Cl. ..... 338/162; 338/150; 338/152; 338/135; 338/163; 338/166

[58] Field of Search ..... 338/135, 150, 338/152, 162, 163, 164, 166, 190

[56] References Cited

U.S. PATENT DOCUMENTS

| | | | |
|---|---|---|---|
| 2,226,629 | 12/1940 | Mather | 338/31 |
| 2,738,405 | 3/1956 | Jorgensen et al. | 338/135 |
| 2,857,496 | 10/1958 | Louis | 338/164 |
| 4,117,444 | 9/1978 | Hildreth et al. | 338/198 |
| 4,225,844 | 9/1980 | Lipp et al. | 338/135 |
| 4,816,801 | 3/1989 | Spiller | 338/163 |
| 5,187,464 | 2/1993 | Forgacs | 338/149 |

FOREIGN PATENT DOCUMENTS

| | | | |
|---|---|---|---|
| 1615712 | 5/1970 | Germany . | |
| 1480729 | 7/1977 | United Kingdom | 338/162 |

OTHER PUBLICATIONS

English translation of Mishler (DE 1615712).

*Primary Examiner*—Teresa J. Walberg
*Assistant Examiner*—Karl Easthom
*Attorney, Agent, or Firm*—Edwin E. Greigg; Ronald E. Greigg

[57] ABSTRACT

The potentiometer has a housing in which a carrier plate which supports a resistance strip is disposed. A rotary pin is supported on the housing and has a sliding contact connected to the rotary pin for engaging the resistance strip. The carrier plate is rotatably connected to the housing and is embodied for the engagement of a turning tool. It assumes its position with regard to the housing because of a frictional connection. The resistance strip can be oriented with regard to the housing or the sliding contact by rotating the carrier plate relative to the housing and the rotary pin.

5 Claims, 1 Drawing Sheet

POTENTIOMETER

BACKGROUND OF THE INVENTION

The invention is based on a potentiometer as defined hereinafter.

DE 16 15 712 A1 has already disclosed a potentiometer of this kind, in which on its side remote from the resistance strip, the carrier plate has a slot that a bottom plate engages in with a positive fit, which plate in turn is non-detachably connected to the housing of the potentiometer by means of a positive fit. During assembly of the potentiometer, the bottom plate serves to align the resistance strip in relation to the housing and thus also in relation to the strip path of the sliding contact, which path is defined by stops on the housing. A later change of the reciprocal orientation is not provided and is also not possible without damaging the housing.

OBJECT AND SUMMARY OF THE INVENTION

The potentiometer according to the invention has the advantage over the prior art that the resistance strip can be aligned in relation to the housing as well as to the strip path of the sliding contact after the assembly of the potentiometer. An adjustment of this kind can be required at the installation point of the potentiometer depending on installation conditions, tolerances, and other factors, for example for adjusting a particular resistance value in the initial position of the sliding contact or for adjusting the sliding contact to the zero point of the resistance strip.

Advantageous improvements and updates of the potentiometer as disclosed are possible by means of the measures taken in the dependent claims.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
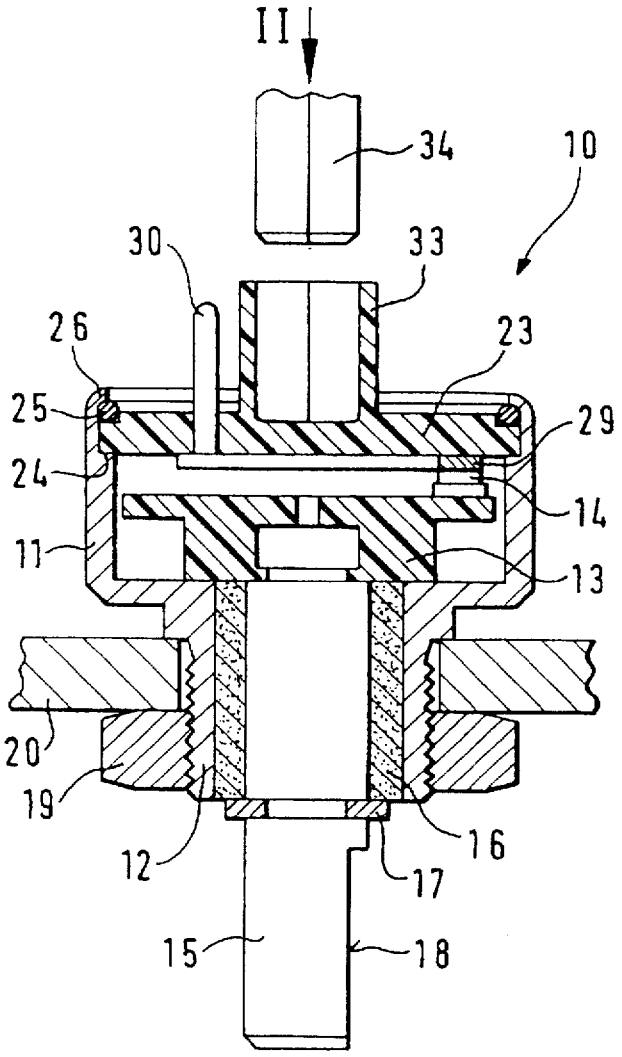
FIG. 1 shows a longitudinal section through a potentiometer according to the invention.

A potentiometer 10 shown in the drawings has a cylindrical housing 11 with a threaded sleeve 12 formed onto it (FIG. 1). The housing 11 contains a plate washer 13 which has a sliding contact 14. The plate washer 13 is non-rotatably connected to a rotary pin 15; that is, it rotates with the rotary pin. A bearing bush 16 disposed inside the threaded sleeve 12 is provided for bearing the rotary pin 15 in the housing 11. A snap ring 17 secures the rotary pin 15 axially. Outside the housing 11, this pin is provided with a flattened surface 18 to which a turning means (not shown) can be attached, which is slid onto the rotary pin 15. A nut 19 that is screwed onto the threaded sleeve 12 connects the potentiometer 10 to a component 20.

A circular carrier plate 23 is inserted into the housing 11 on the side remote from the threaded sleeve 12. The carrier plate 23 is supported on a housing step 24. On its side remote from the housing step 24, the carrier plate is overlapped by the flattened down edge 26 of the housing 11, with the interposition of a rubber elastic sealing ring 25.

Figure 2:
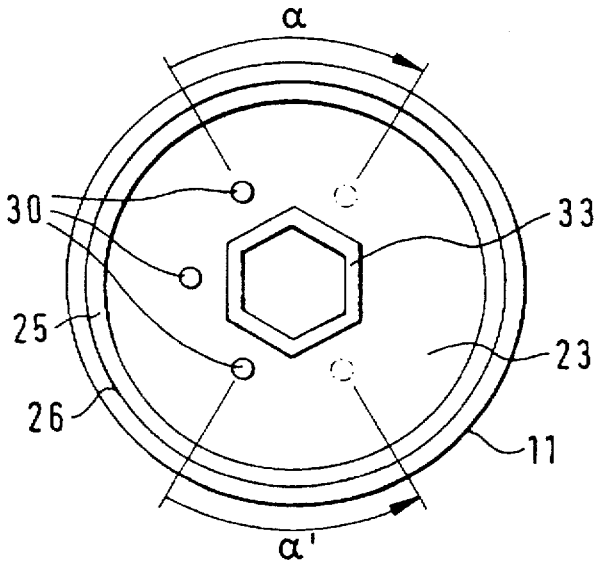
FIG. 2 shows a top view of the potentiometer in FIG. 1, viewed in the direction of arrow II.

On its side oriented toward the plate washer 13, the carrier plate 23 has an arc-shaped resistance strip 29 that runs concentric to the axis of the rotary pin 15. In addition, three contact pins 30 are formed into the carrier plate 23, which protrude from the carrier plate 23 on the side of the housing 11 remote from the rotary pin 15 (FIG. 2). Two of the contact pins are connected to the end points (zero points) of the resistance strip 29. The third contact pin 30 is connected to the sliding contact 14 that engages the resistance strip 29.

The carrier plate 23 can be rotated in relation to the housing 11. For this purpose, it has a central Allen bush 33 that protrudes outward via the housing 11. An Allen wrench 34 can be inserted into this as a turning tool. Other forms of a turning tool can be a screwdriver, an open-ended wrench, a ring wrench, or a pin-type wrench; in a modification of the exemplary embodiment, in order to accommodate the use of these tools, the carrier plate 23 is equipped with a pin that is provided with a straight slot, a phillips slot, a hexagonal shape, or at least two parallel surfaces, or is equipped with blind bores.

The turning of the carrier plate 23 can be required if the housing 11 assumes a particular position because of installation conditions and the rotary position of the rotary pin 15, which position is necessary for the engagement of the turning means, requires an orienting of the resistance strip 29 relative to the sliding contact 14. For example, the rotary pin 15 can assume a position in which the flattened surface 18 runs perpendicular to the plane of the drawing. In accordance with the functional requirements of the potentiometer 10, it can be necessary for example to adjust the resistance strip 29 in relation to the sliding contact 14 in such a way that this engages one of the two end points/zero points of the resistance strip or is positioned at a point on the resistance strip which permits equal or unequal angles of rotation in both rotation directions in which the rotary pin 15 can be moved. In potentiometers that cannot be mechanically spun, stopping means, not shown, assure that the sliding contact 14 does not leave the resistance strip 29.

In FIG. 2, a rotation angle $\alpha$ or $\alpha'$ of the carrier plate 23 in relation to the stationary housing 11 is plotted in the clockwise direction and the counterclockwise direction. In the exemplary embodiment, the rotation angle $\alpha$ or $\alpha'$ is approximately 60°. So that the carrier plate 23 maintains the position with regard to the housing 11 that has been set with a turning tool, a frictional connection is provided between the carrier plate and the housing. This is achieved by means of the sealing ring 25 that is mounted with initial stress, which creates friction forces of sufficient magnitude between itself and the carrier plate 23 on the one hand and between the carrier plate and the housing 11 on the other. The static friction between the components involved is sufficient so that when loaded, the carrier plate 23 maintains its set position by means of the sliding contact 14 and the forces produced at the installation point. Furthermore, the sealing ring 25 prevents a penetration of foreign matter and fluid from the side of the carrier plate 23 into the inside of the potentiometer 10.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A potentiometer (10) comprising a housing (11), a carrier plate (23) that carries at least one resistance strip (29) and is disposed in the housing, means for orienting the resistance strip in relation to the housing, a rotary pin (15) that is supported on the housing, at least one sliding contact (14) is connected onto said rotary pin for engaging the resistance strip, the carrier plate (23) with the resistance (29) thereon is adjustable independently of the actuation of the sliding contact (14) connected to the rotary pin (15), and said carrier plate (23) is embodied for engagement with a turning tool (34) that is rotatably supported on the housing (11) and which is secured to the housing by means of a frictional connection.

2. The potentiometer according to claim 1, in which the carrier plate (23) is embodied as circular, said carrier plate is supported on a housing step (24) and is axially loaded by an element which at least indirectly creates a frictional connection between the carrier plate and the housing (11).

3. The potentiometer according to claim 2, in which the loaded element is a rubber elastic sealing ring (25) that is disposed with initial tension between the carrier plate (23) and the housing (11).

4. The potentiometer according to claim 1, in which, on an outer side of said carrier plate, in a central zone, the carrier plate (23) has a straight slot for engagement of a turning tool.

5. The potentiometer according to claim 1, in which on an outer side of said carrier plate, in a central zone, the carrier plate (23) has a hex shape for engagement of a turning tool.

* * * * *